US008398445B2

(12) United States Patent
Kokkinis

(10) Patent No.: US 8,398,445 B2
(45) Date of Patent: Mar. 19, 2013

(54) AUTOMATIC ICE-VANING SHIP

(75) Inventor: Theodore Kokkinis, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 223 days.

(21) Appl. No.: 12/532,594

(22) PCT Filed: Mar. 24, 2008

(86) PCT No.: PCT/US2008/003823

§ 371 (c)(1),
(2), (4) Date: Sep. 22, 2009

(87) PCT Pub. No.: WO2008/140654

PCT Pub. Date: Nov. 20, 2008

(65) Prior Publication Data

US 2010/0126401 A1 May 27, 2010

Related U.S. Application Data

(60) Provisional application No. 60/928,752, filed on May 11, 2007.

(51) Int. Cl.
*B63H 5/125* (2006.01)
*B63H 20/08* (2006.01)

(52) U.S. Cl. ..... 440/57

(58) Field of Classification Search ..... 114/40–42; 441/3–5; 440/40, 42, 43, 49, 53, 57, 67
See application file for complete search history.

(56) References Cited

U.S. PATENT DOCUMENTS 3,965,840 A 6/1976 Blumberg
4,089,287 A 5/1978 Kranert et al.
4,102,288 A 7/1978 Berry et al.
4,301,760 A 11/1981 Cassone et al.
4,350,114 A 9/1982 Schirtzinger
4,604,961 A 8/1986 Ortloff et al.

(Continued)

FOREIGN PATENT DOCUMENTS

GB 2 118 903 A 11/1983
WO WO 98/46477 A1 10/1998

(Continued)

OTHER PUBLICATIONS

Arpiainen, M. et al, "Revolutionary Oblique Icebreaker", International Conference on Port and Ocean Engineering under Arctic Conditions (POAC), Aug. 23-27, 1999, pp. 552-560, Helsinki, Finland.

(Continued)

*Primary Examiner* — Daniel Venne
(74) *Attorney, Agent, or Firm* — ExxonMobil Upstream Research Company Law Department

(57) ABSTRACT

The present invention discloses apparatuses, systems, and methods for operating a marine vessel, drilling subsea wells, and producing hydrocarbons therefrom. The marine vessel comprises at least two matching pairs of controlled azimuthing propulsion devices to ice-vane the vessel in the event of a changing ice drift or other conditions and keep station in a body of water containing pack ice. In one embodiment, a matching pair of azimuthing propulsion devices are provided. In one embodiment, the propulsion devices share a single physical axis of rotation and in another each propulsion device has its own physical axis of rotation. In another embodiment, the azimuthing propulsion devices are controlled by an automatic control system with a feedback loop. In yet another embodiment, the vessel is substantially oblong having a centrally mounted turret with mooring lines capable of disconnecting from the vessel.

43 Claims, 8 Drawing Sheets

U.S. PATENT DOCUMENTS

| | | | | |
|---|---|---|---|---|
| 4,747,359 | A | 5/1988 | Ueno | |
| 5,036,781 | A | 8/1991 | Jarvi | |
| 5,218,917 | A | 6/1993 | Harjula et al. | |
| 5,380,229 | A | 1/1995 | Korsgaard | |
| 5,823,715 | A | 10/1998 | Murdoch et al. | |
| 5,950,732 | A | 9/1999 | Agee et al. | |
| 6,012,406 | A | 1/2000 | Dudley et al. | |
| 6,162,105 | A | 12/2000 | Breivik | |
| 6,790,109 | B1 * | 9/2004 | Heer et al. | 440/53 |
| 6,799,528 | B1 | 10/2004 | Bekker | |
| 6,848,382 | B1 | 2/2005 | Bekker | |
| 6,886,487 | B2 | 5/2005 | Fischer, III | |
| 7,681,511 | B2 * | 3/2010 | Breivik et al. | 114/40 |
| 2003/0226487 | A1 | 12/2003 | Boatman et al. | |
| 2005/0193938 | A1 | 9/2005 | Boatman et al. | |
| 2006/0096513 | A1 | 5/2006 | Kulikov et al. | |

FOREIGN PATENT DOCUMENTS

| | | | |
|---|---|---|---|
| WO | WO 2006/058400 | A1 | 6/2006 |
| WO | WO 2007/089152 | A1 | 8/2007 |

OTHER PUBLICATIONS

Backstrom, K., "Frontier Discoverer Project-Kulluk Management Contract", 2nd Arctic Passion Seminar, Mar. 15, 2007, 9 pages, Helsinki, Finland.

Doyle, T. et al., "Terra Nova Vessel Design and Construction," OTC 11920, 2000 Offshore Technology Conference, May 1-4, 2000, pp. 1-17, Houston, Texas.

Duggall A. S. et al., "Global Analysis of the Terra Nova FPSO Turret Mooring System," OTC 11914, 2000 Offshore Technology Conference, May 1-4, 2000, pp. 1-11, Houston, Texas.

Harris, R. J. S. et al., "Concrete FPSO", SPE 54530, SPE Prod. & Facilities, Feb. 1999, pp. 47-55, v. 14, n. 1.

Hinkel, R. M. et al., "Experience With Drillship Operations in the U. S. Beaufort Sea", OTC 5685, 20th Annual OTC, May 2-5, 1988, pp. 35-48, Houston, Texas.

Jorde, J., "Arctic Drill Ship—Joint Venture Development Project between Statoil and LMG Marin", 9th Annual INTSOK Conference, Mar. 7-8, 2007, pp. 1-10, Houston, Texas.

Juurmaa, K. et al., "New Ice Breaking Tanker Concept for the Arctic (DAT)", 13th International Conference on Port and Ocean Engineering under Arctic Conditions (POAC), Aug. 15-18, 1995, pp. 62-71, Murmansk, Russia.

Lohi, P. et al, "MSV Fennica, A Novel Icebreaker Concept", IceTech '94, Society of Naval Architects & Marine Engineers, 1994, pp. M1-M14, Calgary, Alberta, Canada.

European Search Report No. 115513, Oct. 30, 2007, 3 pages.

* cited by examiner

AUTOMATIC ICE-VANING SHIP

CROSS REFERENCE TO RELATED APPLICATIONS

This application is the National Stage of International Application No. PCT/US2008/003823, filed Mar. 24, 2008, which claims priority to U.S. provisional application No. 60/928,752, filed on May 11, 2007.

FIELD OF THE INVENTION

This invention relates generally to a method to enhance drilling and production operations from sub-sea wells. More particularly, this invention relates to a system, apparatus, and associated methods of operating a moored vessel in seas or oceans containing pack ice.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Keeping station in drifting pack ice is a challenging task for an offshore platform. Bottom-founded platforms have been successfully developed for shallower water. In deeper water (notionally in water depth of 75 m or greater), however, bottom-founded platforms become impractical, and floating platforms need to be employed. Such floating platforms may keep station with the help of a mooring system consisting of several mooring lines made of steel (wire or chain) or synthetic materials. Drifting pack ice impacting the floating platform produces loads in the mooring lines. Such loads can become very high when the ice conditions are severe, leading to breakage of the lines.

A ship-shape vessel is attractive as a floating platform in drifting pack ice because: it has a large deck area, it has a large under-deck volume, and ice loads on it from drifting pack ice are relatively low when the vessel is aligned with the ice drift direction.

However, if the ice drift direction changes, a ship-shape vessel could be impacted by the drifting ice on the beam, resulting in significantly higher ice loads than when aligned with the ice drift direction. Such ice loads may exceed the capacity of even the strongest mooring systems that have been designed to date.

If the mooring system is attached to a turret about which the vessel may rotate in the ice, the vessel can eventually align itself with the new ice drift direction (ice-vane), and ice loads can reduce to the original, relatively low, levels. The problem is that pack ice may prevent the rotation of the vessel about the turret. In order for the vessel to rotate, it breaks up and clears ice upstream near the bow and downstream near the stern. This can be a slow process, and while it is happening, mooring loads may significantly increase. To mitigate such increase in the loads, faster and easier break up and clearance of ice is preferred.

A variety of vessels have been designed and/or built to deal with the particular problems associated with subsea oil and gas drilling and production in areas having significant ice incursions. One example is an FPSO (Floating Production Storage and Offloading) in Terra Nova. The Terra Nova FPSO is a turret-moored vessel equipped with a thruster-assisted position mooring system in which the thrusters are automatically controlled. However, the design of the system is primarily driven by the harsh open-water wave and wind conditions at the Terra Nova site. The pack ice design condition for Terra Nova is very mild: 5/10ths ice coverage with 0.3 m ice thickness. The Terra Nova thruster system is, thus, not designed to break up and clear ice or facilitate the ice-vaning of the vessel. The vessel has 5 thrusters (2 at the bow and 3 at the stern) arranged to optimize station-keeping performance in high wave/wind conditions. Moreover, the automatic control system for the thrusters is designed for open water conditions, and does not have any functions for determining ice drift direction or commanding the thrusters to do what is necessary to align the vessel with changing ice drift direction. The vessel is intended to disconnect and leave the field in more severe pack ice conditions, should such conditions ever occur, or in case an iceberg gets too close to it.

One typical solution includes the use of other vessels called "support icebreakers" to break up and clear the ice in the areas necessary for the moored vessel to ice-vane. This is not a satisfactory solution, as it introduces considerable operational complexity and risk. The support icebreakers have to correctly identify the prevailing ice conditions and move through the ice repeatedly to break it up and clear it. On many occasions, they will have to accomplish this in close quarters with the moored vessel and under conditions of poor visibility and other adverse weather conditions (snow, high winds, etc.). Depending on the ice conditions, more than one icebreaker may need to be active in a particular area, which increases the risk for collision between icebreakers and also between an icebreaker and the moored vessel. Because of the uncertainty about the effectiveness of icebreaker operations, this type of solution usually also includes a capability to disconnect the mooring system to avoid breaking it, if the loads due to the ice exceed the capacity of the system. While the capability to disconnect mitigates the risk of breaking mooring lines, it introduces further operational complexity and risk, particularly if the moored vessel has no propulsion and steering of its own. Failure to properly manage the vessel after disconnection may lead to collision and grounding.

Disclosed herein are several examples of vessels designed to solve some of the problems associated with sub-sea oil and gas drilling and production in arctic areas. Kvaerner Masa Yards in the 1990s developed a new type of ship for sailing in ice, named Double-Acting Tanker (DAT), which employs pulling azimuthing thrusters at the end of the ship that first meets the ice for propulsion (see K. Juurmaa, et al. infra. and U.S. Pat. No. 5,218,917). Aker-Finnyards in the 1990s built at least two multi-purpose icebreaker support vessels utilizing azimuthing thrusters, which utilize azimuthing thrusters for propulsion and maneuvering (see P. Lohi, et al. infra). Kvaerner Masa Yards in the 1990s proposed a triangular asymmetric icebreaker with three azimuthing thrusters, called the oblique icebreaker (see M. Arpiainen, et al. infra). The principle of operation is to use the entire side of the vessel to break ice, taking advantage of a special oblique hull form. By operating this way, the oblique icebreaker can break a much wider channel in the ice than ship-shape icebreakers for escorted ships to follow in. Den Norske Stats Oljeselskap has apparently developed a two-part ship for use in oil transport in arctic waters, which consists of a barge part containing a number of loading tanks and a propulsion part, which is adapted for breaking ice and has one or more azimuthing thrusters (U.S. Pat. No. 6,162,105). The propulsion part joins with the barge part for sailing through ice-covered waters (similar to a tug-barge used in open water). Upon arrival at a field location, the barge part connects to a submerged turret buoy, and the propulsion part separates from it. While the barge part is intended to ice-vane about the submerged turret buoy, it is not equipped with any active system to facilitate such ice vaning. Only the propulsion part has azimuthing thrusters.

The Canadian Marine Drilling Company (CANMAR) developed a series of ship-shape drillships, which they used for drilling operations in the Beaufort Sea. The drillships were primarily intended to drill in the open water season (summer), but to be able to withstand occasional incursions of drifting pack ice (see R. M. Hinkel, et al. infra). Frontier Drilling engaged Aker Arctic to conduct initial design and conceptual work for their turret-moored drillship Frontier Discoverer. This work includes development of a modified hull form and protection for the riser from the ice, but it does not include a special thruster arrangement or control system (see K. Bäckström infra).

Statoil and LMG Marin have developed a design for an Arctic DrillShip (ADS) with icebreaker features. The ADS has an icebreaker hull, ice cutters around the hull of the ship, thrusters aft and forward and turret mooring for water depths from 50 meters (m) to 1,000 m (see J. Jorde infra, and Int'l Patent App. WO2007/089152). However, the Statoil design requires the development of new ice cutter technology and fails to consider problems of automatic control.

At a concept level, Sandwell, Inc. conducted a paper study in 1996-97 for Mobil and Texaco, in which Sandwell developed concepts for an in-ice Floating Production, Storage and Offloading Structure (see Sandwell infra). Two of the concepts developed involved a ship-shape hull: 1) a conventional "moveable" icebreaking FPSO, which had an efficient icebreaking hull, bow thrusters for improved maneuvering, and to enhance its ice clearance and station-keeping capabilities in ice and a disconnectable mooring. This FPSO was intended to operate with ice management support of two "very capable" icebreakers, supplemented at times by a third; and 2) an extreme "permanent" FPSO, that had a much more extreme icebreaking hull with large reamers for self-ice management, with a number of azimuthing thrusters for improved maneuvering, and to enhance its ice clearance and station-keeping capabilities in ice. This FPSO was intended to rely primarily on self-ice management, but Sandwell's system included one "capable" icebreaker, supplemented at times by a second. While the mooring system was intended to be permanently connected, the concept included disconnectability in extreme situations. This concept did not include matching thruster pairs, or automatic control of the thrusters.

Also at a concept level, Kulikov and Ruksha (U.S. Pat. App. No. 2006/0096513) proposed a single-point system for tankers to moor at an offshore terminal for the purpose of loading liquids, primarily oil, from an onshore tank farm in ice conditions. This system utilizes a combination loading hose-mooring line attached to a fixed structure at the seabed allowing 360 degree)(°) rotation, and an icebreaker to lead the tanker through ice to the location of the offshore terminal, equipped with a guiding trunk that protects the loading hose from ice action. Although this system is claimed to offer "the possibility of roundabout turning," it includes no elements specifically designed to facilitate and accelerate ice-vaning. Furthermore, this system addressed the problem of only temporary mooring of tankers in ice for a short-duration operation, with the option of stopping the operation and disconnecting the mooring.

Accordingly, an apparatus, system, and method are needed that effectively breaks up and manages ice incursions on a turret-moored marine vessel, facilitates and accelerates ice-vaning, and is capable of keeping a relative position in pack ice conditions to mitigate the impact of ice on the vessel.

Related material may be found in at least: "Global Analysis of the Terra Nova FPSO Turret Mooring System," Paper 11914, Proceedings, Offshore Technology Conference, Houston, Tex., May 1-4, 2000; "Terra Nova Vessel Design and Construction," Paper 11920, Proceedings, Offshore Technology Conference, Houston, Tex., May 1-4, 2000; "Experience with Drilling Operations in the US Beaufort Sea," R. M. Hinkel, S. L. Thibodeau and A. Hippman, Paper 5685, Proceedings, Offshore Technology Conference, Houston, Texas, May 2-5, 1988; "An Arctic Drilling Campaign in Alaska," K. Bäckström, 2$^{nd}$ Annual Arctic Passion Seminar, Helsinki, Finland, Mar. 15, 2007; "Arctic Drill Ship—For Year-Round Operations in Arctic Environments," J. Jorde, 9$^{th}$ Annual INTSOK Conference, Houston, Tex., Mar. 27-28, 2007; "Revolutionary Oblique Icebreaker," M. Arpiainen, M. Baeckstroem and R-A. Suojanen, Proceedings, POAC 1999, Helsinki, Finland, August 23-27, 1999; "Mobil/Texaco In-Ice Floating Production, Storage and Offloading Structure Feasibility Study," report by Sandwell, Inc., Vancouver, BC, Canada, August 1997; "New Ice Breaking Tanker Concept for the Arctic (DAT)," K. Juurmaa, G. Wilkman and M. Baeckstroem, Proceedings, 13th International Conference on Port and Ocean Engineering under Arctic Conditions (POAC), Murmansk, Russia, Aug. 15-18, 1995; "MSV Fennica, A Novel Icebreaker Concept," P. Lohi, H. Soininen and A. Keinonen, Proceedings, IceTech '94, Calgary, Alberta, Canada, 1994; Int'l Patent App. WO2007/089152; U.S. Patent App. 2006/0096513; U.S. Pat. Nos. 6,848,382; 6,799,528; 6,162,105; 5,218,917; and 4,747,359.

SUMMARY

One embodiment of the present invention discloses a marine vessel. The marine vessel includes a hull, the hull being operatively connected to a mooring turret and at least a portion of the hull being configured to resist ice loads. The vessel further includes at least two matched pairs of azimuthing propulsion devices operatively engaging the hull, wherein each of the at least two matched pairs of propulsion devices are configured to provide a net force on the hull and clear ice away from the hull. A control system is also provided, which is operatively connected to the at least two matched pairs of azimuthing propulsion devices and configured to enable control of the marine vessel via the propulsion devices. The vessel may further be configured to ice-vane or keep station via the propulsion devices, the control system may be automatic, the hull may be ship-shaped, and the vessel may be one of a drillship, a floating production, storage, and offloading vessel (FPSO), a floating production of liquefied natural gas vessel (FLNG), a floating storage and regasification unit for LNG (FSRU), a gas-to-liquids floating production, storage and offloading vessel (GTL), a gas-to-chemicals floating production, storage and offloading vessel (GTC), and a sailing LNG carrier.

Another embodiment of the present invention discloses a control system for a marine vessel. The control system includes at least two matched pairs of azimuthing propulsion devices operatively attached to the marine vessel, wherein each of the at least two matched pairs of propulsion devices are configured to provide a net force on the marine vessel and clear ice away from the marine vessel; a plurality of sensors operatively connected to the marine vessel configured to provide at least one input parameter; and a plurality of azimuthing propulsion device control commands, wherein the control system controls the plurality of azimuthing propulsion devices utilizing the azimuthing propulsion device control commands and the at least one input parameter. The control system may further be configured to ice-vane the vessel or keep station, may be automatic, and may include a feedback loop.

A third embodiment of the present invention discloses a method of producing hydrocarbons. The method includes positioning a vessel in a body of water having pack ice. The vessel includes a hull operatively connected to a mooring turret, wherein at least a portion of the hull is configured to resist ice loads; and at least two matched pairs of azimuthing propulsion devices operatively engaging the hull, wherein each of the at least two matched pairs of propulsion devices are configured to provide a net force on the hull and clear ice away from the hull. The method further includes operatively connecting the vessel to a subsea wellhead, wherein the subsea wellhead is configured to produce hydrocarbons, operating the vessel utilizing the at least two matched pairs of azimuthing propulsion devices, and receiving the hydrocarbons into the vessel.

A fourth embodiment of the present invention discloses a method of manufacturing a marine vessel. The method includes constructing a marine vessel, wherein the vessel comprises a hull operatively connected to a mooring turret, wherein at least a portion of the hull is configured to resist ice loads; and the vessel includes at least two matched pairs of azimuthing propulsion devices operatively engaging the hull, wherein each of the at least two matched pairs of propulsion devices are configured to provide a net force on the hull and clear ice away from the hull.

A fifth embodiment of the present invention discloses a method of drilling a subsea well. The method includes positioning a vessel in a body of water having pack ice. The vessel includes a hull operatively connected to a mooring turret, wherein at least a portion of the hull is configured to resist ice loads; and at least two matched pairs of azimuthing propulsion devices operatively engaging the hull, wherein each of the at least two matched pairs of propulsion devices are configured to provide a net force on the hull and clear ice away from the hull. The drilling method further includes operatively connecting the vessel to a subsea wellhead, wherein the subsea wellhead is configured to enable the drilling of the subsea well; and operating the vessel utilizing the at least two matched pairs of azimuthing propulsion devices.

BRIEF DESCRIPTION OF THE DRAWINGS

The foregoing and other advantages of the present techniques may become apparent upon reviewing the following detailed description and drawings in which.

DETAILED DESCRIPTION

Figure 1A:
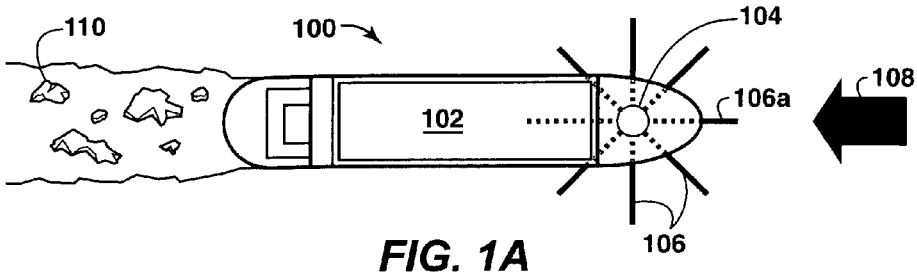
FIG. 1A (Prior Art)
FIGS. 1A-1C illustrate exemplary environmental conditions and conventional vessel configurations.

In the following detailed description section, the specific embodiments of the present invention is described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The term "ice-vaning" refers to the method of aligning of a turret-moored marine vessel having a substantially oblong hull shape —with the length dimension of vessel greater than the width dimension —with the prevailing ice drift direction, which may shift dynamically, either continuously or intermittently. Aligning means making the length dimension of the vessel substantially coincident with the prevailing ice drift direction.

The term "station keeping" refers to the method of maintaining the position of a vessel in a body of water. If the vessel is in a body of water containing pack ice, the term "station keeping" includes mitigating the effect of ice on the vessel while maintaining position.

The term "azimuth" refers to the ability of a propulsion device (e.g. a thruster) or pair of propulsion devices to rotate about an axis. Preferably, the axis is substantially vertical with respect to the deck portion of the vessel and the rotation is preferably at least about 180 degrees)(°), more preferably at least about 270°, or most preferably at least about 360° around the axis.

The phrase "matched pair of azimuthing propulsion devices" means that at least two propulsion devices form a functionally integrated pair rather than operating independently of each other. For example, the propulsion devices may be physically integrated, such as when both propulsion devices rotate about the same physical axis or the propulsion devices may be operationally integrated such as when the motions and actions of the two propulsion devices are connected by a control system and the actions of one propulsion device affect the actions of the other propulsion device. In some cases, the matched pair of azimuthing propulsion devices are both physically integrated and operationally integrated.

When referring to a hull, the term "ship-shape" means a hull with one dimension in the horizontal plane (length) significantly greater than the other dimension (breadth or beam).

In one embodiment of the present invention the apparatus includes a turret-moored marine vessel having an ice-breaking hull and azimuthing propulsion devices in matched pairs. Preferably, the propulsion devices in each matched pair azimuth or rotate about a vertical axis so that they substantially oppose each other.

In another embodiment of the present invention, the matched pairs of azimuthing propulsion devices are operatively connected to a control system to facilitate and accelerate ice-vaning and station keeping and in general for the purpose of reducing ice loads on the moored vessel. The control system may be automatic and include a feedback loop. This system, including the turret-moored vessel and its mooring system, may be referred to as the automatic ice-vaning ship ("AIS").

In yet another embodiment of the present invention, the AIS is a turret-moored vessel intended to keep station at a particular location in drifting pack ice. The AIS may utilize a computerized system to detect the effect of changing ice drift direction on the mooring line loads, and to generate appropriate commands for the propulsion devices to simultaneously break up and clear ice, rotate the vessel about the turret and reduce mooring line loads. The AIS may further comprise azimuthing propulsion devices in matched pairs, configured to break up ice around the vessel, clear ice in specific areas around the vessel, rotate the vessel to align it (or vane) with a change in ice drift direction, and resist ice loads in order to minimize mooring line loads.

Figure 1B:
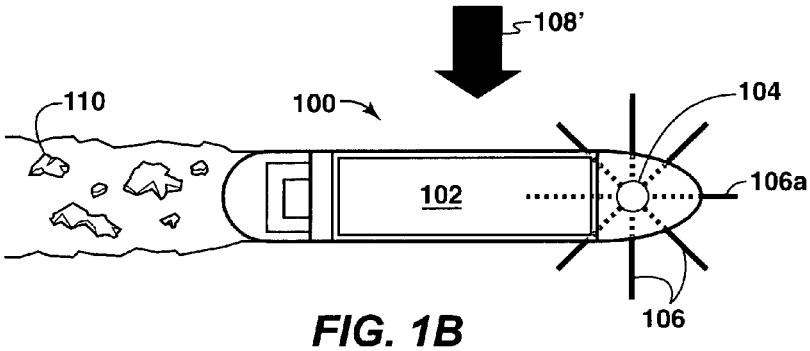
FIG. 1B (Prior Art)
Figure 1C:
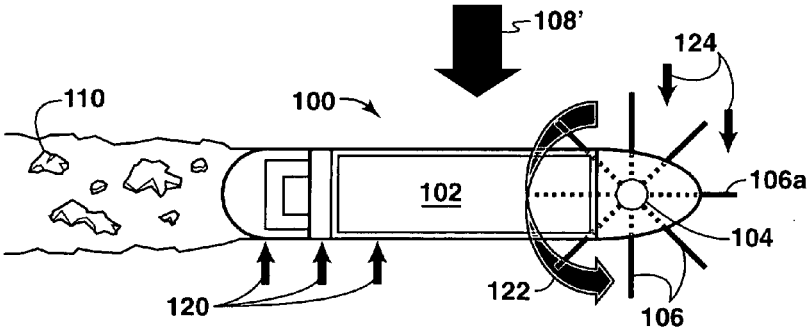
FIG. 1C (Prior Art)

Referring now to the drawings, FIGS. 1A-1C illustrate exemplary environmental conditions and conventional vessel configurations. FIG. 1A shows an exemplary configuration of a vessel 100 with a ship-shaped hull 102, which is moored via a turret 104 and a plurality of mooring lines 106 and 106*a*, wherein the vessel 100 is connected to a sub-sea well (not shown) via a production riser, drilling riser, or similar connection member (not shown). The vessel 100 is floating in drifting ice 108 and creating a channel 110 as the ice is broken up by the bow portion of the hull 102. In this configuration, the greatest amount of tension is in the mooring line 106*a* extending from the bow portion of the hull 102. In this configuration, the ice-breaking shape and strength of the bow provides for relatively easy break-up of the ice resulting in relatively low loads on the mooring lines 106 and 106*a*.

FIG. 1B illustrates the vessel 100 wherein the ice drift 108' has changed direction. In this scenario, the ice incursion occurs along the long portion of the ship-shaped hull 102, which provides a significantly larger surface area to impact the vessel 100. When the ice impacts the flat, wide profile of the side of the hull 102, it will generate a substantially larger force on the hull 102, the turret 104, mooring lines 106 and other equipment than the condition in FIG. 1A. As such, it is advantageous to rotate the vessel 100. FIG. 1C illustrates the vessel 100 as it is attempting to rotate 122 around the turret 104. However, the rotation 122 is resisted by forces 120 and 124 against the hull 102 caused by ice present near the hull 102 in those areas.

Figure 2A:
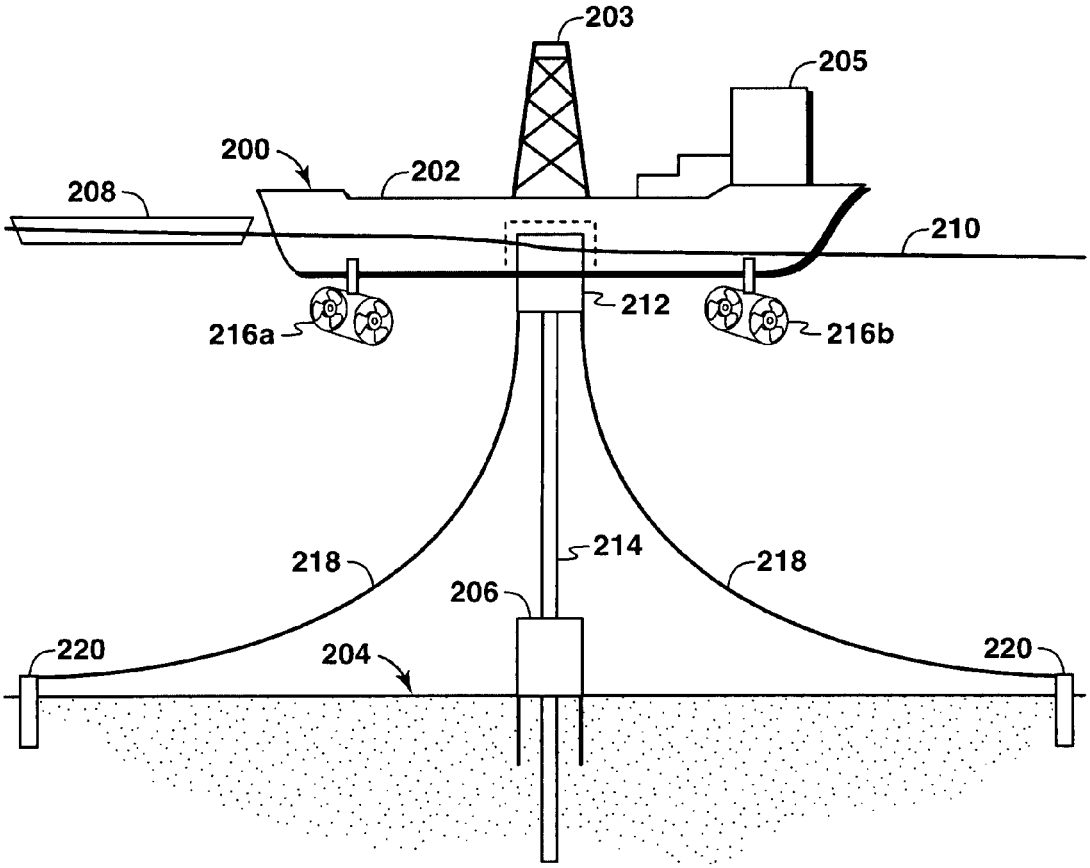
FIGS. 2A-2E show side views and bottom views of illustrations of exemplary embodiments of the vessel of the present invention.
Figure 2B:
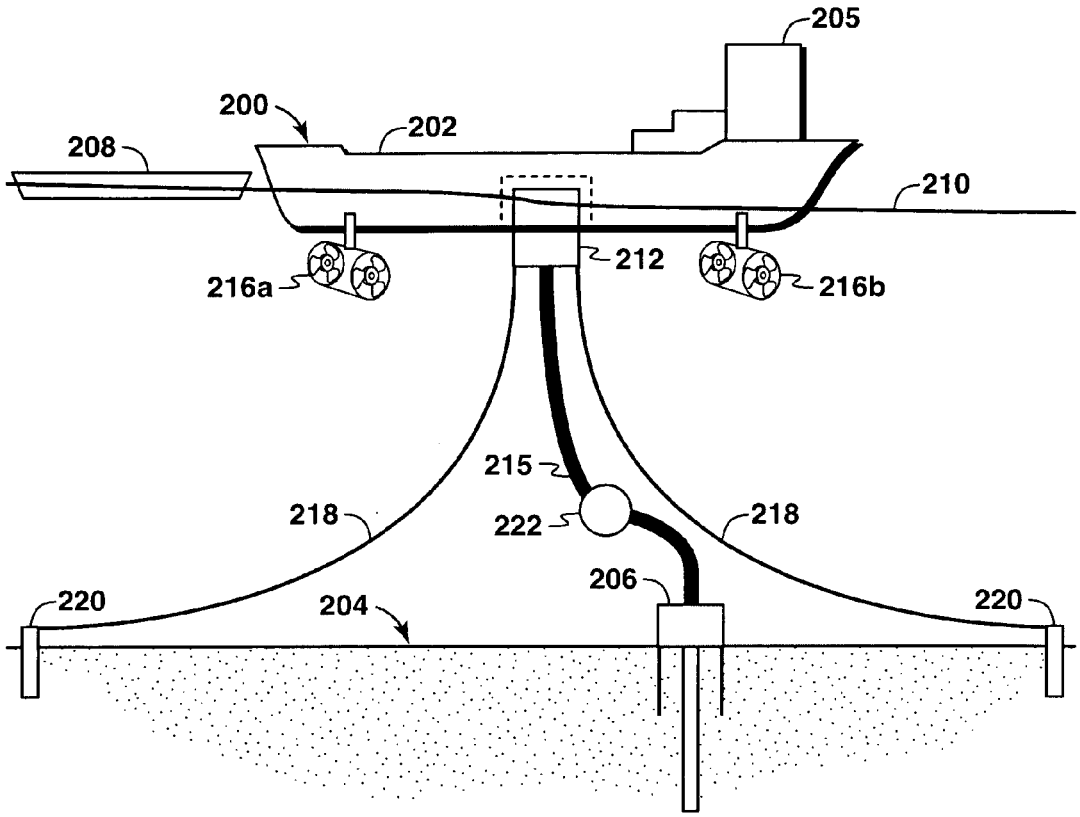

FIGS. 2A-2E show side views and bottom views of illustrations of exemplary embodiments of the vessel of the present invention. The vessel 200 comprises a hull 202, which may be substantially oblong or ship-shaped, matched pairs of propulsion devices 216*a* and 216*b* (which may be referred to collectively as 216), a drilling derrick 203, above-deck facilities 205, a mooring-turret 212 connected to at least one mooring line 218 with anchors 220, and a drilling riser 214 connecting the vessel 200 to a subsea well head 206. The apparatus 200 is floating in a body of water 210 over a sea-bed 204, wherein pack ice 208 is floating in the water 210. A variation of this exemplary embodiment, as shown in FIG. 2B, may not have a drilling derrick, but may instead include one or more production risers 215, possibly supported by underwater buoys 222, connecting the vessel 200 to a subsea wellhead 206.

One preferred exemplary embodiment shown in FIGS. 2A-2B and 2D-2E comprises a symmetric hull 202 with a centrally located turret 212. Such an arrangement allows minimizing the amount of rotation (e.g. limiting the travel distance of the end-points of the hull 202) needed to achieve alignment with any given ice drift direction. However, the present invention does not require a symmetric hull 202 or a centrally located turret 212. In alternative embodiments, as shown for example in FIG. 2C, the turret 212 may be located anywhere along the length of the hull 202 to optimize the arrangement for the particular intended application or environment of the vessel 200.

One exemplary embodiment of the present invention comprises a vessel 200 having a ship-shape hull 202. The hull 202 is preferably ice-strengthened to resist ice loads caused by the ice conditions in which the vessel 200 is intended to operate. Exemplary applications include a drillship, as illustrated in FIG. 2A, comprising a vessel 200 for drilling offshore oil and gas wells in pack ice. In addition to the mooring lines 218, the turret 212 of such a vessel 200 may include a drilling riser 214. Another exemplary application is a vessel 200 for floating production, storage, and offloading (FPSO) of hydrocarbons (e.g. crude oil), as illustrated in FIG. 2B, in which the vessel 200 is configured to produce hydrocarbons from a subsea formation, then process, store and transfer the hydrocarbons. In addition to the mooring lines 218, the turret 212 of such a vessel 200 may include a number of risers 215, including production, water injection, gas re-injection, and possibly also oil and gas export risers 215. Yet another exemplary application is a vessel 200 for floating production of liquefied natural gas (LNG) (not specifically illustrated), sometimes called an FLNG in which the vessel 200 is configured to liquefy the gas and store the resulting LNG into tanks either within or on top of the hull 202. In addition to the mooring lines 218, the turret 212 of such a vessel 200 may include a number of risers 215, including production and water injection, and possibly also cryogenic fluid export. Still another exemplary application is a floating storage and regasification unit for LNG (not specifically illustrated), sometimes called an FSRU. In addition to the mooring lines 218, the turret 212 of such a vessel 200 may include one or more cryogenic fluid import risers 215, as well as one or more gas export risers 215. Other applications of the vessel 200 may include a gas-to-liquids floating production, storage and offloading vessel (GTL), a gas-to-chemicals floating production, storage and offloading vessel (GTC), and a sailing LNG carrier. The size of the vessel 200 may vary according to application.

One preferred embodiment includes the propulsion devices 216 in matched pairs as illustrated in FIGS. 2A-2E. The matched pairs of azimuthing propulsion devices 216 are preferably configured to perform at least three functions: 1) break-up and clear ice in specific areas around the vessel 200, 2) rotate the vessel 200 to align it with a change in ice drift direction, and 3) resist ice loads in order to minimize mooring line 218 loads. The propulsion devices 216 may also be capable of keeping station in a body of water 210 containing ice pack 208 and maneuvering the vessel 200 in both open water and pack ice. Although many configurations of matched pair azimuthing propulsion devices will work, a preferred configuration includes one pair of propulsion devices 216 at each end of the vessel 200. Another exemplary embodiment may comprise a ship-shaped hull 202 having a mooring-turret 212 located two-thirds to three-quarters of the length of the hull 202 away from the stern portion, and having three pairs of azimuthing propulsion devices 216, one pair 216 under the stern portion, one pair 216 under the bow portion, and one pair 216 approximately between the first two pairs.

Figure 2C:
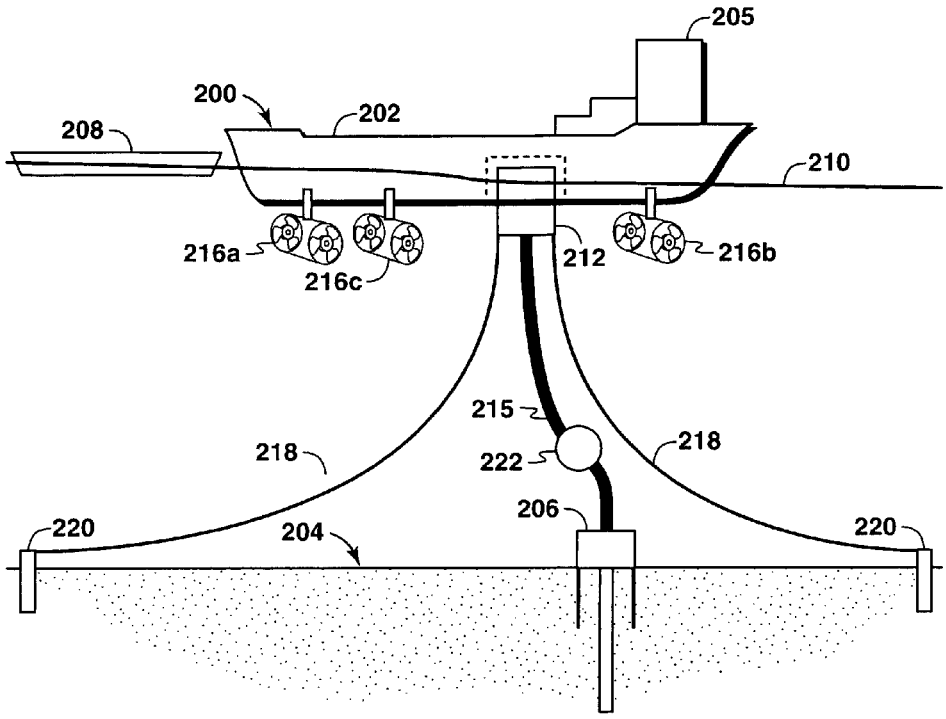

In one exemplary embodiment, as illustrated in FIG. 2C, the vessel 200 comprises three propulsion device pairs 216*a*, 216*b*, and 216*c*. Additional propulsion devices (not shown) may also be included that may be solitary and may not azimuth. Additional propulsion devices may be added without departing from the spirit and scope of the present invention.

Figure 2D:
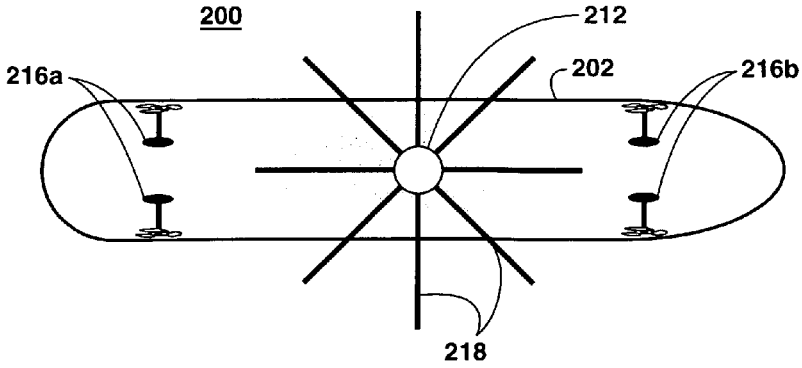
Figure 2E:
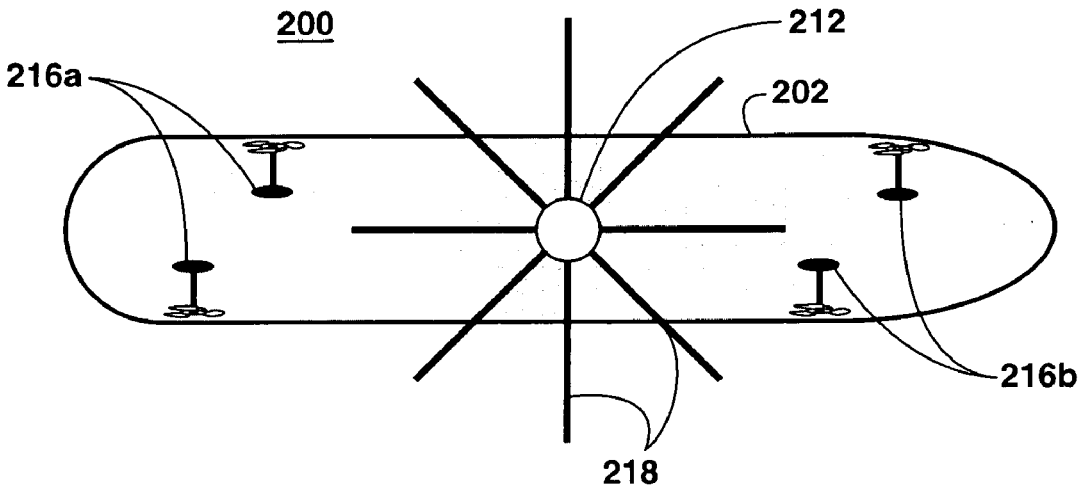

In another exemplary embodiment, as illustrated in FIGS. 2D-2E showing the bottom of the hull 202, the propulsion devices 216 may azimuth about different physical axes. The physical axes may be aligned as shown in FIG. 2D or offset along the length and width of the hull 202 as shown in FIG. 2E. The propulsion devices 216 may be any appropriate propulsion device, such as a propeller, a thruster, a propulsor, or a waterjet, so long as it is capable of propelling the vessel 200 and breaking up and clearing away ice. The size and numerosity of the propulsion devices 216 will depend on the design of the vessel 200 for each application, but should be sufficient to position the vessel 200 in an ice field, break-up expected ice, wash ice away from the vessel 200, and resist ice loads to minimize mooring line 218 loads, as needed. Note that the propulsion device pairs 216 of the present invention may have a significantly different shape and size from the illustrated figure in accordance with engineering specifications and other design considerations. For example, the propulsion devices 216 may be any type of propeller (e.g. a controllable pitch, fixed pitch, and/or counter-thrusting propeller), thruster, propulsor, or water jet and may include features such as pitch control, tunnels for quieter operation, under water replacement, and retractability. Two exemplary propulsion devices are the AZIPOD® podded propulsor made by ABB and the MERMAID™ podded propulsor made by KAMEWA™. Each of these systems comprises powerful (5-25 megawatts per propulsor) propulsors and would include two distinct pods on separate axes, but can be configured to operate as a matching pair in accordance with some embodiments of the present invention.

Figure 3A:
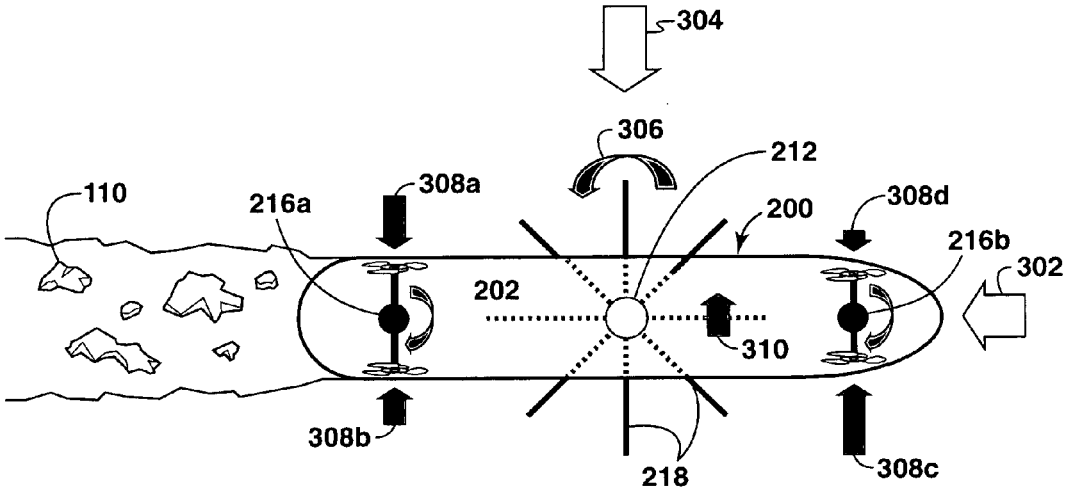
FIGS. 3A-3B illustrate an exemplary embodiment of methods and an apparatus of the present invention as shown in FIGS. 2A-2E including exemplary environmental conditions and responses.
Figure 3B:
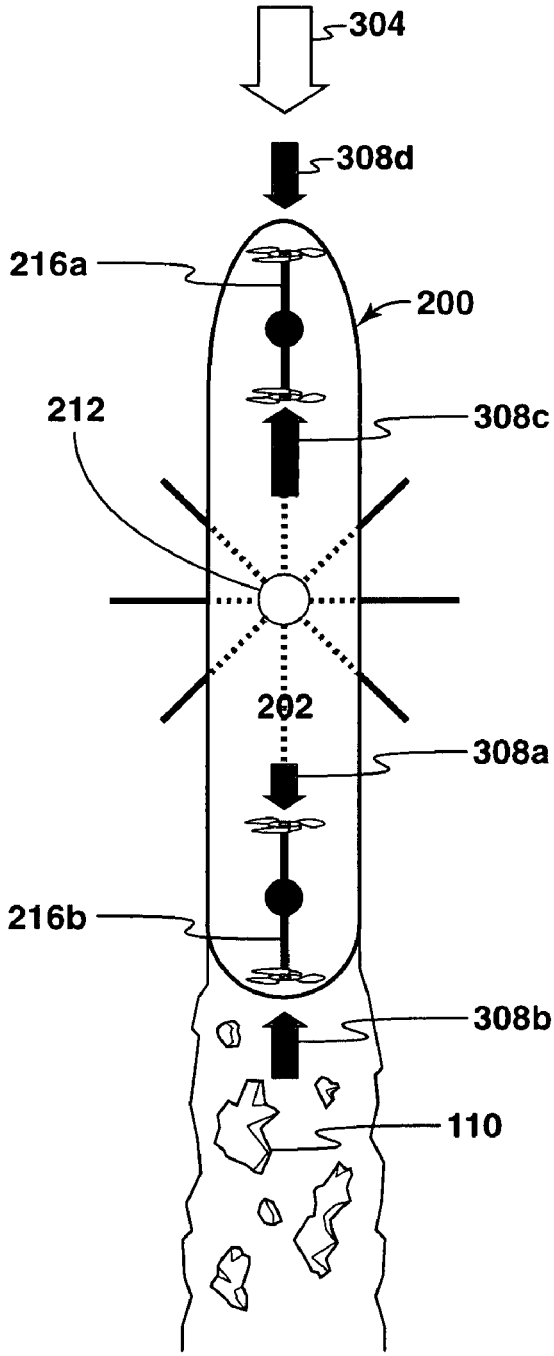

FIGS. 3A-3B illustrate an exemplary embodiment of methods and an apparatus of the present invention as shown in FIGS. 2A-2E including exemplary environmental conditions and responses. Accordingly, FIGS. 3A-3B may be best understood by concurrently viewing FIGS. 2A-2E. FIG. 3A shows an oblong vessel 200 having a centrally mounted turret-mooring system 212 with mooring lines 218 and two pairs of propulsion devices 216*a* and 216*b*. The vessel 200 is located in an ice field 300 with an ice drift having a first direction 302 and a second direction 304. Also shown are the net moment 306 about the turret 212, propulsion device forces 308*a*-308*d*, and the net force opposing the ice drift 310. FIG. 3B shows the vessel 200 in substantial alignment with the ice drift 304 after accomplishing an ice-vaning operation utilizing certain aspects of the present invention.

Referring to FIG. 3A, in one preferred embodiment of a method for ice-vaning, one of the propulsion devices in each matched pair 216*a* or 216*b* produces higher force 308*a* and 308*c* than the other propulsion devices 308*b* and 308*d*, respectively. As such, the propulsion device pairs 216*a* and 216*b* produce a net force resulting in a net moment 306 to rotate the vessel 200 about its turret 212 to align the vessel 200 with the changing ice drift direction 304. During the rotation of the vessel 200, the wash of the lower force propulsion devices 308*b* and 308*d* break up and clear the ice ahead of the advancing hull 202 of the vessel 200. Additionally, the combined thrust of all propulsion devices 216 produces a net force 310 in a direction opposing the ice drift direction 304, which is intended to reduce the loads resulting from the ice 300 on the mooring lines 218. In this exemplary illustration, the net force 310 is obtained by the difference between the sum of the forces 308*b* and 308*c* and the sum of the forces 308*a* and 308*d* being a positive number. FIG. 3B illustrates station keeping of the vessel 200 after application of the disclosed exemplary maneuvering or ice-vaning method. The propulsion device pairs 216*a* and 216*b* are operating to reduce or negate the forces on the mooring lines 218 caused by the ice drift 304, operating to break up ice as it approaches the bow portion of the vessel 200 and wash the ice away as it drifts by the stern portion of the vessel 200.

Preferably, the number and capacity of the propulsion device pairs 216 is determined on the basis of the capability of the mooring system 212, 218, and of the ice conditions 300 in which the vessel 200 is operating. A sufficient number of propulsion device pairs or sets 216 is included to have the desired redundancy, (e.g. to retain sufficient capability to maintain mooring loads and offsets within allowables following any single-point failure). The power generation and distribution system (not shown) of the present invention should have similar redundancy, (e.g. should be able to provide sufficient power to maintain mooring loads and offsets within allowables following any single point failure). In such a preferred exemplary embodiment, the vessel 200 may not require icebreaker support, thus eliminating the issues associated with icebreaker operations around the vessel 200, including collision hazards.

Figure 4:
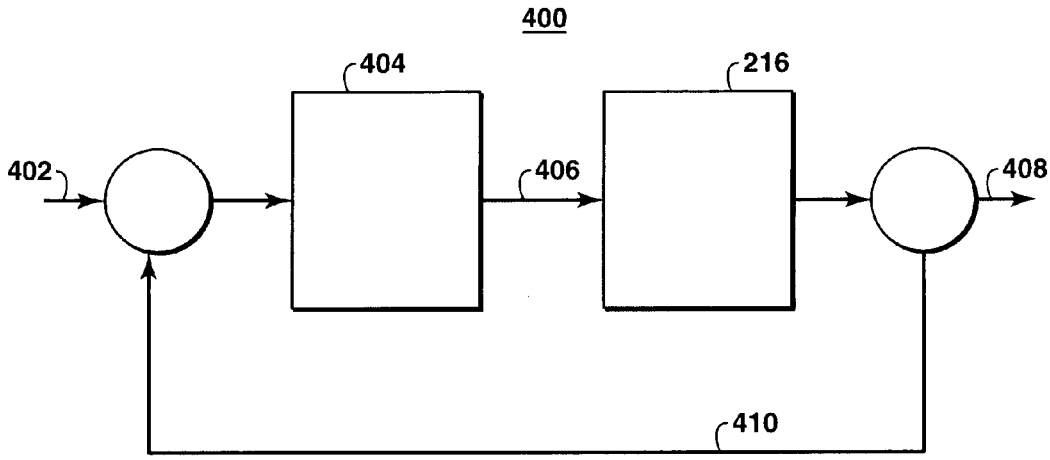
FIG. 4 illustrates an exemplary control system for use in combination with the propulsion devices of the vessel of FIGS. 2A-2E and 3A-3B and methods for using the same.

FIG. 4 illustrates an exemplary control loop for a control system 400 for use in combination with the propulsion devices 216 of the vessel 200 of FIGS. 2A-2E and 3A-3B. Accordingly, FIG. 4 may be best understood by concurrently viewing FIGS. 2A-2E and 3A-3B. FIG. 4 shows an exemplary control system 400 comprising an input 402, a controller 404, commands 406, the propulsion devices 216, output or response 408, and a feedback loop 410. The system 400 may further include sensors to measure output or response 408, and a user interface (not shown) to provide input 402 or control 404. The controller 404 may be manually operated or automatic and may include computer readable data or code and may be embodied in a software program. The connections between the sensors, the user interface, the controller 404 and the propulsion devices 216 may be wired or wireless. Note that the control system 400 may be fully automated or may include a combination of automated and manual controls.

In one preferred embodiment, the control system 400 is an automatic control system and includes a feedback loop 410 to provide inputs 402 as external conditions change, thereby allowing a user to enter an initial desired result 408 and allow the system 400 to make automatic adjustments or commands 406 until the initial desired result 408 is accomplished. This is preferable to a manual system requiring a user to monitor the system 400 for errors and make adjustments for errors. The system 400 may be designed as a standard feedback control loop, a pre-programmed control, a feed-forward control, and/or a prediction followed by control. See LEIGH, J. R., CONTROL THEORY, 2d Ed., The Institution of Electrical Engineers (2004), which is hereby incorporated by reference.

In one preferred embodiment, the system 400 is configured to monitor the loads on each mooring line 218 to identify the ice drift direction 302, 304. Each mooring line 218 may be equipped with a device to measure the load in it (e.g. a load cell). The system 400 may further identify the ice drift direction 302, 304 using a model of the mooring system 212, 218 and the vessel 200. Qualitatively, the ice drift direction 302, 304 may be approximated by the direction of the most loaded mooring lines 218. By comparing the ice drift direction 302 or 304 to the heading of the vessel 200, the system 400 may determine a preferred direction of rotation of the vessel 200, to align with the changing ice drift direction 302 or 304. The system 400 may then issue commands 406 to the thrusters 216 to produce a net moment 306 about the turret 212 to accomplish the rotation. The system 400 may also monitor the rate of rotation and heading of the vessel 200 via a sensing device. If the rate is slower than preferred, the system 400 may issue a command 406 to the propulsion devices 216 whose wash is used to break up and clear ice. The system 400 may also commensurately command 406 the other propulsion devices 216 to maintain the net moment 306 about the turret 212. Also through monitoring of the mooring line 218 loads, the system 400 may determine how close these loads are to the allowable loads of the mooring lines 218 (defined as the breaking strength divided by a safety factor). If the loads are close to the allowable loads, the system 400 may command 406 the propulsion devices 216 to produce a net force 310 opposing the ice drift direction 302 or 304 to help reduce mooring line 218 loads. Other inputs 402 to the control system 400 may include temperature, precipitation, ice thickness, water salinity, horizontal orientation of the vessel 200, and any other input useful for ice-vaning or station keeping the vessel 200. The outputs 408 may include propulsion device 216 wash, net moment 306 about turret 212, net force 310 opposing ice drift 302 or 304, propulsion device 216 speed, vessel speed, load on a mooring line 218, and any combination thereof.

In one exemplary embodiment, the system 400 may include an input parameter 402 such as, for example, feed-forward of wind loads (measured using anemometers or other wind sensors), the controller 404 may calculate the wind loads on the vessel 200 using a mathematical model, then command 406 the propulsion devices 216 to produce an output 408 such as a force and moment to counteract the wind force and moment. The sensors and other feedback devices may then provide input 402 to the system 400 after the force 408 is applied so the system 400 may make adjustments for the changing conditions and any possible errors encountered.

One exemplary embodiment includes mooring lines 218 (and other equipment connecting the vessel 200 to the seabed 204), which are permanently attached to the vessel 200 via the turret 212. However, the invention also includes an alternate embodiment comprising a vessel 200 with a turret 212 capable of disconnecting, which allows disconnection of the mooring lines 218 and other equipment (e.g. risers 214 or 215), either for operational purposes or for minimizing the risk of damage to the mooring lines 218 and other equipment. In such embodiments, the automatic control system 400 includes modes for controlling the propulsion devices 216 for sailing the vessel 200 through pack ice and/or open water, so that the movement of the vessel 200 remains under control, minimizing the risk of collision and/or grounding following disconnection.

Although the vessel 200 may operate in any sufficiently large body of water, it is preferable to operate the vessel 200 in bodies of water having drifting pack ice such as, for example, the Beaufort Sea, the Chukchi Sea, the Gulf of Finland, the Sea of Okhotsk, the Barents Sea, the Kara Sea, and other Russian Arctic seas.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the invention as defined by the following appended claims.

What is claimed is:

1. A marine vessel, comprising:

a hull, wherein the hull is operatively connected to a mooring turret whereby the hull is rotatable about the mooring turret;

at least two matched pairs of azimuthing propulsion devices operatively engaging the hull, wherein the azimuthing propulsion devices in each matched pair substantially oppose each other and are independently operable; and a control system operatively connected to the at least two matched pairs of azimuthing propulsion devices whereby the marine vessel is controlled via the propulsion devices, wherein the control system via the propulsion devices performs at least one of ice-vaning the vessel and keeping the vessel at a station in a body of water containing pack ice, wherein the control system via the at least two matched pairs of azimuthing propulsion devices (a) generates a net moment to rotate the vessel about the mooring turret to align the vessel with an instantaneous ice drift direction, (b) concurrently clears the ice ahead of the vessel hull as it rotates, and (c) generates a net force opposing the ice drift.

2. The vessel of claim 1, wherein the control system comprises a controller.

3. The vessel of claim 1, wherein the control system includes at least one input parameter.

4. The vessel of claim 3, wherein the input parameter is one of at least one mooring line load, vessel heading, vessel rotation, wind speed, and any combination thereof.

5. The vessel of claim 1, wherein the control system comprises a feedback loop.

6. The vessel of claim 1, wherein the matched pairs of azimuthing propulsion devices are at least one of propellers, water jets, and thrusters.

7. The vessel of claim 1, further comprising three matched pairs of azimuthing propulsion devices.

8. The vessel of claim 1, further comprising at least one additional propulsion device.

9. The vessel of claim 1, wherein both azimuthing propulsion devices in each of the at least two matched pairs are configured to azimuth about a single axis.

10. The vessel of claim 1, wherein the azimuthing propulsion devices in each of the at least two matched pairs are configured to azimuth each about a different axis.

11. The vessel of claim 10, wherein the axes are offset from each other along a length and width of the hull.

12. The vessel of claim 1, further comprising a plurality of mooring lines operatively connected to the mooring turret at one end and anchored into a seabed at the other end.

13. The vessel of claim 1, wherein the vessel is adapted and configured to enable the drilling of subsea wells.

14. The vessel of claim 1, wherein the vessel is configured to produce hydrocarbons from a subsea formation.

15. The vessel of claim 1, wherein the vessel is configured to do at least one of process, transfer, and store hydrocarbons.

16. The vessel of claim 1, further comprising liquefied natural gas (LNG) tanks, wherein the vessel is configured to receive LNG from LNG carriers into the tanks, transform at least a portion of the LNG to gaseous form and transfer the gas through a subsea pipeline to an onshore location.

17. The vessel of claim 1, wherein the mooring turret is disconnectable.

18. The vessel of claim 1, wherein the hull comprises a substantially oblong shape comprising a bow portion and a stern portion.

19. The vessel of claim 18, wherein at least one matched pair of azimuthing propulsion devices is positioned approximately under the bow portion of the hull and at least one matched pair of azimuthing propulsion devices is positioned approximately under the stern portion of the hull.

20. The vessel of claim 18, wherein the mooring turret is positioned approximately midway between the bow portion and the stern portion of the hull.

21. The vessel of claim 18, wherein the mooring turret is positioned at any portion of the hull between the bow portion and the stern portion.

22. The vessel of claim 1, wherein the vessel is one of a drillship, a floating production, storage, and offloading vessel (FPSO), a floating production of liquefied natural gas vessel (FLNG), a floating storage and regasification unit for LNG (FSRU), a gas-to-liquids floating production, storage and offloading vessel (GTL), a gas-to-chemicals floating production, storage and offloading vessel (GTC), and a sailing LNG carrier.

23. A control system for a marine vessel, comprising:

at least two matched pairs of azimuthing propulsion devices operatively attached to the marine vessel having a hull, wherein the hull is operatively connected to a mooring turret whereby the hull is rotatable about the mooring turret, wherein the azimuthing propulsion devices in each matched pair substantially oppose each other and are independently operable;

a plurality of sensors operatively connected to the marine vessel configured to provide at least one input parameter; and a plurality of azimuthing propulsion device control commands, wherein the control system controls the plurality of azimuthing propulsion devices utilizing the azimuthing propulsion device control commands and the at least one input parameter, wherein the control system via the propulsion devices performs at least one of ice-vaning the vessel and keeping the vessel at a station in a body of water containing pack ice, wherein the control system via the at least two matched pairs of azimuthing propulsion devices (a) generates a net moment to rotate the vessel about the mooring turret to align the vessel with an instantaneous ice drift direction, (b) concurrently clears the ice ahead of the vessel hull as it rotates, and (c) generates a net force opposing the ice drift.

24. The control system of claim 23, further comprising a feedback loop.

25. The control system of claim 23, wherein the at least one input parameter is selected from one of mooring line loads, vessel heading, vessel rate of rotation, wind speed, wind direction, and any combination thereof.

26. The control system of claim 23, wherein the plurality of azimuthing propulsion devices control commands are selected from the group consisting of azimuth orientation, speed, thrust, vertical orientation, and any combination thereof.

27. The control system of claim 23, further comprising a hull, wherein the hull is operatively connected to a mooring turret.

28. The control system of claim 27, comprising a plurality of mooring lines operatively connected to a mooring turret.

29. The control system of claim 28, wherein the hull is configured to withstand dynamic loads caused by ice impact.

30. The control system of claim 29, wherein the vessel is configured to produce hydrocarbons from a subsea formation.

31. The control system of claim 23, wherein the vessel is configured to enable the drilling of subsea wells.

32. The control system of claim 23, wherein the vessel further comprises liquefied natural gas (LNG) tanks, wherein the vessel is configured to receive LNG from LNG carriers into the tanks, transform at least a portion of the LNG to gaseous form and transfer the gas through a subsea pipeline to an onshore location.

33. A method of producing hydrocarbons, comprising:

positioning a vessel in a body of water having pack ice, wherein the vessel comprises:

a hull operatively connected to a mooring turret whereby the hull is rotatable about the mooring turret;

at least two matched pairs of azimuthing propulsion devices operatively engaging the hull, wherein the azimuthing propulsion devices in each matched pair substantially opposed each other and are independently operable; and a control system operatively connected to the at least two matched pairs of azimuthing propulsion devices whereby the vessel is controlled via the propulsion devices, operatively connecting the vessel to a subsea wellhead;

operating the vessel utilizing the at least two matched pairs of azimuthing propulsion devices to ice-vane the vessel and keep the vessel at a station in a body of water containing pack ice, wherein the control system via the at least two matched pairs of azimuthing propulsion devices (a) generates a net moment to rotate the vessel about the mooring turret to align the vessel with an instantaneous ice drift direction, (b) concurrently clears the ice ahead of the vessel hull as it rotates, and (c) generates a net force opposing the ice drift;

producing hydrocarbons from the subsea wellhead; and receiving the hydrocarbons into the vessel.

34. The method of claim 33, further comprising storing the hydrocarbons in the vessel.

35. The method of claim 33, further comprising transferring the hydrocarbons to a tanker.

36. The method of claim 33, further comprising delivering the hydrocarbons to an onshore facility.

37. The method of claim 33, wherein the vessel is within twenty miles of the subsea wellhead.

38. The method of claim 33, wherein operating the vessel further comprises a control system, wherein the control system is configured to reposition the vessel utilizing the at least two pairs of azimuthing propulsion devices.

39. The method of claim 38, wherein the control system is configured to perform at least one of ice-vaning the vessel and keeping the vessel at a station in a body of water containing pack ice.

40. The method of claim 39, the automatic control system further comprising a feedback loop.

41. A method of drilling a subsea well, comprising:

positioning a vessel in a body of water having pack ice, wherein the vessel comprises:

a hull operatively connected to a mooring turret whereby the hull is rotatable about the mooring turret;

at least two matched pairs of azimuthing propulsion devices operatively engaging the hull, wherein the azimuthing propulsion devices in each matched pair substantially oppose each other and are dependently operable; and a control system operatively connected to the at least two matched pairs of azimuthing propulsion devices whereby the marine vessel is controlled via the propulsion devices, wherein the control system via the propulsion devices performs at least one of ice-vaning the vessel and keeping the vessel at a station in a body of water containing pack ice, wherein the control system via the at least two matched pairs of azimuthing propulsion devices (a) generates a net moment to rotate the vessel about the mooring turret to align the vessel with an instantaneous ice drift direction, (b) concurrently clears the ice ahead of the vessel hull as it rotates, and (c) generates a net force opposing the ice drift;

operatively connecting the vessel to a subsea wellhead, wherein the subsea wellhead enables the drilling of the subsea well;

drilling the subsea well; and operating the vessel utilizing the at least two matched pairs of azimuthing propulsion devices.

42. The method of claim 41, further comprising a control system, wherein the control system is configured to reposition the vessel utilizing the at least two pairs of azimuthing propulsion devices.

43. The method of claim 42, wherein the control system further comprises a feedback loop.

* * * * *